US005163310A

United States Patent [19]

Wang

[11] Patent Number: 5,163,310

[45] Date of Patent: Nov. 17, 1992

[54] CYLINDRICAL LOCK STRUCTURE

[75] Inventor: Mao-Hsiung Wang, Paiho, Taiwan

[73] Assignee: Cheeng IU Industrial Co., Ltd., Chia-yi, Taiwan

[21] Appl. No.: 795,379

[22] Filed: Nov. 21, 1991

[51] Int. Cl.[5] ..... E05B 27/08

[52] U.S. Cl. ..... 70/491

[58] Field of Search ..... 70/360, 404, 491, 496

[56] References Cited

U.S. PATENT DOCUMENTS 3,411,331 11/1968 Schlage ..... 70/491
3,863,475 2/1975 Foss ..... 70/360

FOREIGN PATENT DOCUMENTS 908584 4/1954 Fed. Rep. of Germany ..... 70/491
243441 5/1969 U.S.S.R. ..... 70/491

*Primary Examiner*—Lloyd A. Gall
*Attorney, Agent, or Firm*—Morton J. Rosenberg; David I. Klein

[57] ABSTRACT

A cylindrical lock core is provided having a first plug member with a cross-shaped keyway, four blind holes formed in a lower portion thereof, and a flange at top portion having a projection extending downwardly therefrom. A second plug member is located underneath the first plug member. The second plug member also has a cross-shaped keyway, includes four through holes and a projection extending from one side thereof. The second plug member also has a plurality of setting walls disposed between each aperture of the keyway and each through hole. Each of the through holes is terminated by a small aperture disposed at the bottom end thereof. A plurality of springs are positioned in the blind holes and on each rests a first tumbler pin, each of which has a portion disposed in the first plug member and a remaining portion disposed within the second plug member, which also contains a second tumbler pin in axial alignment. A barrel is provided for receipt of the plug members. When a legal key is inserted through the keyway and rotated to lift up the tumbler pins, the first tumbler pins will be positioned entirely within the first plug member and the second tumbler pins will be positioned entirely within the second plug member, thereby permitting the lock core to rotate, as it is in an unlocked condition.

2 Claims, 3 Drawing Sheets

CYLINDRICAL LOCK STRUCTURE

BACKGROUND OF THE INVENTION

1. Field of the Invention

The invention is in the field of a cylindrical lock structure. In particular, the invention is directed to a lock core having a plurality of pins extending downwardly in a direction opposite to that of the keyhole and requiring a specific key to lift the pins from their bottom end, within the core, to operate the lock.

2. Prior Art

Conventional lock mechanisms typically have their pins urged by springs toward a keyway, the keyway being arranged with notches to receive the pins. When a valid key is in position, the pins are so arranged that a plug is rotatable in a body. When the key is withdrawn, the pins span the junction between the plug and the body and prevent or block rotation of the plug in the body. However, such lock cores can easily be opened by inserting two sticks into the keyway and rotating the two sticks in opposite directions.

The lock structure of the instant invention has a plurality of pins axially extending between two barrel members and urged by springs in a direction opposite to the key aperture, and which can only be actuated by a special valid key.

SUMMARY OF THE INVENTION

It is considered advisable and desirable to have a lock structure which requires a special key to be inserted through a keyway to the bottom of the core, within the lock body, and to rotate the key to a predetermined position where the key will be urged to move upward by a restoring spring. The key then urges the pins to move upwardly and to lie entirely in the respective first or second plug, the second plug then being rotatable.

It is therefore an object of the present invention to provide a cylindrical lock structure which includes pins which are axially urged by springs toward a direction opposite that of the keyway.

Another object of the invention is to provide a cylindrical lock structure by a simple modification to the standard lock structure.

Another object of the invention is to provide the cylindrical lock structure having pins projecting downward which are operable only from inner bottom side of the lock.

Another object of the invention is to provide a special key that cannot easily be duplicated.

A further object of the invention is to provide a cylindrical safety lock structure.

DETAILED DESCRIPTION OF THE PREFERRED EMBODIMENT

Figure 1A:
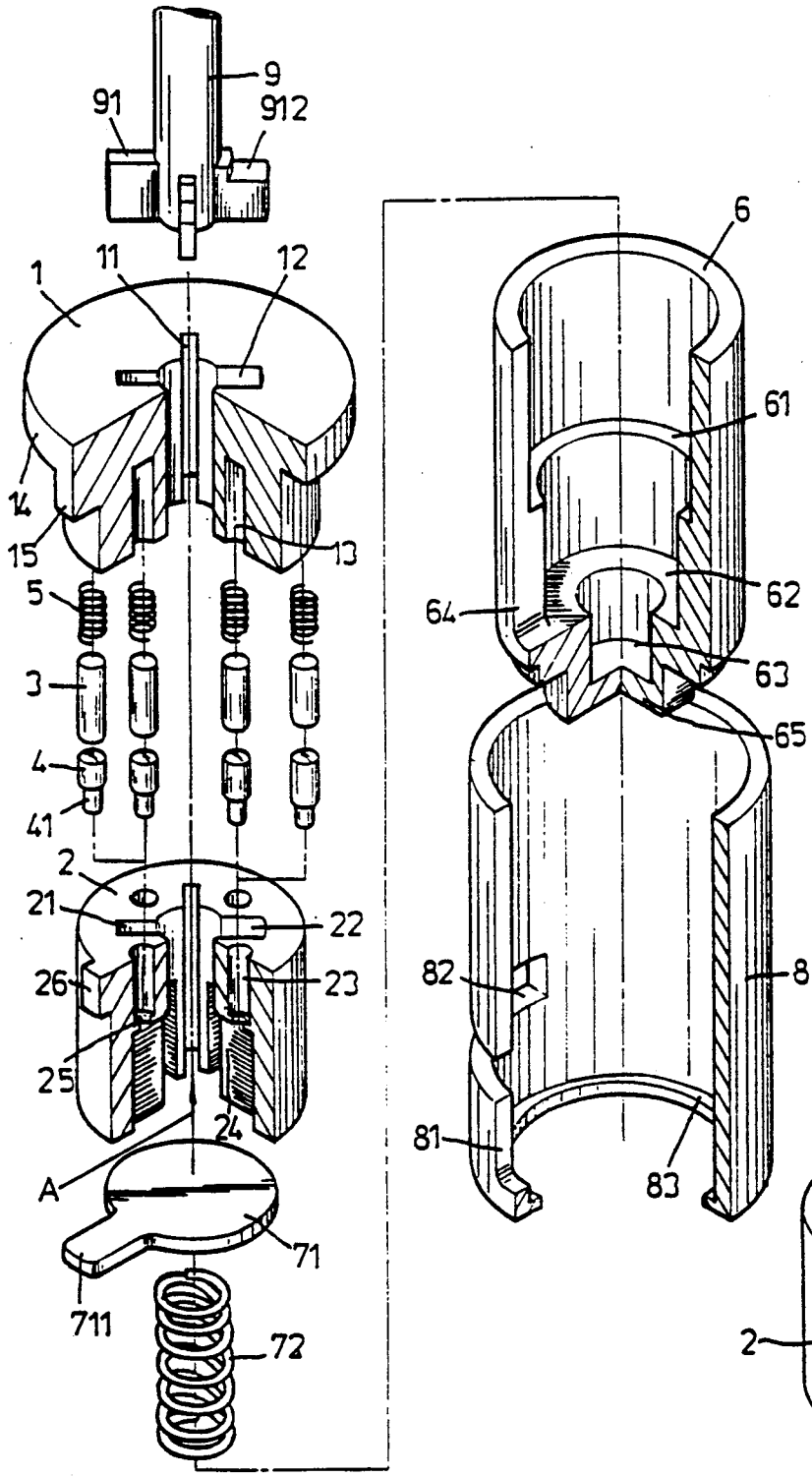
FIG. 1A is an exploded view of a lock structure of the present invention.

The present invention, as shown in FIG. 1A, is composed of a first plug member 1, a second plug member 2, a plurality of first and second tumbler pins 3 and 4, a plurality of springs 5, a cylindrical barrel 6, a cylindrical shell 8, a setting means 71, 72 and a valid key 9.

The first plug member 1 includes a cross-shaped keyway 11 extending along an axis therethrough, and having an aperture 12 of large dimension as a setting aperture. The first plug member 1 is further provided with a plurality of blind bores 13, wherein each bore is disposed between adjacent apertures of the cross-shaped keyway 11. Each of the bores extends axially from the bottom surface of the first plug to a point midway through the thickness of the first plug member. First plug member 1 is formed with a circular ledge 14 at the top end thereof, with a flange 15 extending downward from the ledge 14.

The second plug member 2 is cylindrical in shape having a cross-shaped keyway 21 extending axially therethrough. The cross-shaped keyway 21 is formed with an aperture 22 of large dimension. The second plug member 2 is further provided with a plurality of through bores 23, each having a bottom end formed with a smaller diameter hole 25. Second plug member 2 is formed with a plurality of setting walls 24 disposed between adjacent apertures of the keyway 21, and between each of the through holes 23. A flange 26 is provided to extend from the upper cylindrical surface of second plug member 2. The keyway 21, the aperture 22, the through holes 23, and the flange 26 are all positionally located for respective alignment with the corresponding structures of the first plug member 1.

Each of the springs 5 is respectively received in the blind bores 13 and are positioned to be on the top end of each of the respective first pins 3. Each of first pins 3 has a portion lying in a respective blind bore 13 of the first plug member 1 and a portion lying in a respective through bore 23 of the second plug member 2. Each of first pins 3 are positioned on a respective one of the second pins 4. Each second pin 4 has a reduced diameter portion 41 for insertion through and resting on a shoulder surrounding the small hole 25 of the second plug member 2.

Figure 5:
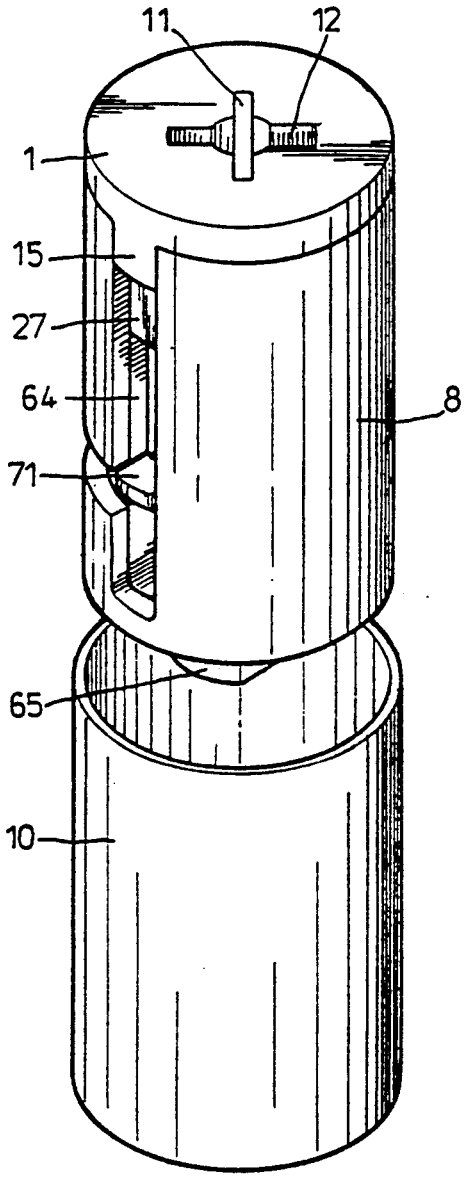

The cylindrical barrel 6 has a hollow body and is formed with an opening at one end to accommodate the two plug members 1 and 2, plug member 1 being disposed above plug member 2. A first radial step 61 is provided on the interior of the barrel to axially support the stacked plug members. A second radial step 62, having a small diameter dimension than that of the diameter dimension of the setting plate 71 is provided as a stop to axial displacement of setting plate 71. A small blind hole 63 at the inner bottom portion of barrel 6 is provided to accept a restoring spring 72. A vertical channel 64, shown in FIG. 5, is formed in one side of barrel 6 to guide a projection 711 of the setting plate 71, permitting projection 711 to freely slide therein. The opposing end of barrel 6 is provided with a latch 65.

The setting means is defined by a restoring spring 72 having one end disposed in the small hole 63 of the barrel 6, and a setting plate 71 supported by the opposing end of restoring spring 72.

The shell 8 is cylindrical in shape and has a hollow body open on one end to accommodate receipt of the barrel 6 therein, an opening on the opposing end permits extension of the latch 65 therethrough. Shell 8 is provided with a vertical channel 81 formed in one side thereof, and in alignment with the channel 64 of the barrel 6. Channel 81 extends axially from the upper edge of shell 8 to a ledge 83, which extends inwardly at the bottom end of shell 8. A slit 82 is formed in the wall of shell 8 to extend laterally from the vertical channel 81, the slit 82 having a length equal to one fourth of the circumference of the shell 8.

The vertical channel 81 serves as a guide for the free vertical movement of projection 711 of the setting plate 71, when the setting plate 71 is pushed down by the key 9, or urged upwardly by the restoring spring 72. The slit 82 serves as a guide for the projection 711 to slide horizontally when a rotational force is applied through the barrel 6, which is driven by the second plug member 2 when operating by a legal key 9, as will be described in following paragraphs.

The key 9 is formed with a cylindrical post at its top portion, and four rectangular shaped arms 91 at its bottom portion. Each arm 91 is equally spaced at the bottom portion and each has a different height, such that when urged by the restoring spring 72 to move upward, the arms 91 of different height cause displacement of first pins 3 through the displacement of second pins 4 by contact between the pin portions 4 and the upper surface of respective arms 91. If the different height of arms 91 are complemented by respective different length pins 4, then all of the pins 3 will be entirely disposed in the first plug member 1, and all of the pins 4 will be entirely disposed within the second plug member 2, creating an unlocked condition.

Figure 1B:
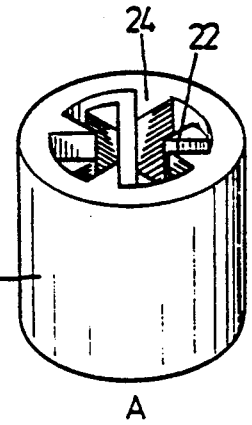
FIG. 1B is a perspective bottom view of the second plug member.

Referring to FIG. 1B, there is shown, the bottom end of second plug member 2, where every other one of the setting walls 24 have a cutout portion. The cutout portions provide a space into which the arms 91 of a valid key 9 may pass when rotated.

Figures 2A, 2B, 3A, 3B, 4A, 4B:
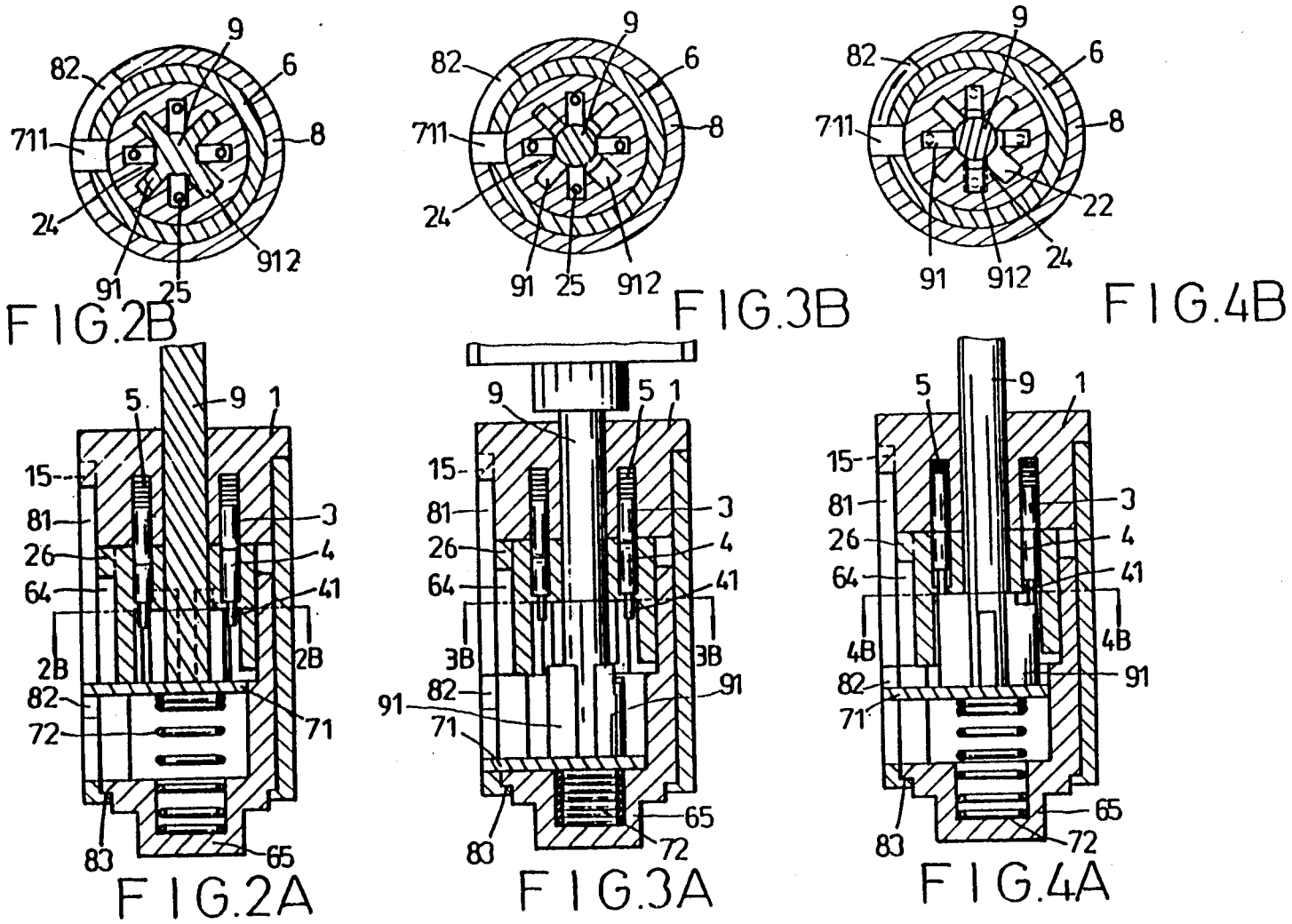
FIG. 2A is a partial side sectional view of the lock structure of FIG. 1 showing a first pin member disposed both in a first plug and in a second plug, and a valid key resting on a setting plate.
FIG. 2B is a top cross-sectional view taken along the Section Line 2B—2B of FIG. 2A.
FIG. 3A is a partial side sectional view of the lock structure showing a setting plate and a restoring spring being pressed down to the bottom portion of a barrel by a valid key.
FIG. 3B is a top cross-sectional view taken along the Section Line 3B—3B of FIG. 3A.
FIG. 4A is a partial side sectional view of the lock structure showing the valid key pushed upward and the pins being disposed entirely in the first or the second plugs.
FIG. 4B is a top cross-sectional view taken along the Section Line 4B—4B of FIG. 4A; and, FIG. 5 is a perspective view of the present invention separated from a housing.

Referring to FIG. 2A, there is shown, a side sectional view showing a valid key 9 inserted into the lock core through the keyway 11, and resting on the setting plate 71, which in its normal condition is urged upwardly by the restoring spring 72 to be in contact with the bottom end of the second plug member 2. The arms 91 of the key 9 are located in the keyway 11 and blocked from rotation by the setting walls 24 of the second plug member 2. One are 912 is of wider dimension than the other arms, and coincides with the larger size apertures 12, 22 of the respective plug members 1 and 2.

FIG. 2B is a top cross-sectional view showing the position of the arms 91 of key 9 being located in the keyway. As shown, the projection 711 of the setting plate 71 is located in the channel 81.

FIG. 3A shows the key 9, the setting plate 71, and the restoring spring 72 pushed down within the barrel 6. The setting plate 71 rests on the second radial step 62. The arms 91 of the key 9 are positioned in the area between the first radial step 61 and the second radial step 62. The cutout portions at the bottom end of alternate setting walls 24 are formed such that the height of the arms 91 of the key 9 may pass through the cutout, and then are stopped from further rotation by the uncut setting walls. FIG. 3B is a top cross-sectional view showing no change from that of FIG. 2B, since the key 9 has not yet been rotated.

Referring to FIG. 4A, there is shown, the key 9 subsequent to being rotated into alignment with the pins, and being blocked by the uncut walls 24. Upon the user releasing the downward push force from the key, the plate 71 and key 9 are urged upward by the restoring spring 72. The arms 91 of the key 9 push the first and the second tumbler pins 3 and 4 in an upward direction. Because the heights of each of arms 91 are arranged differently, but complementary to the pins 4, the tumbler pins 3 and 4 are displaced such that each of the tumbler pins 3 is positioned entirely within the first plug member 1 and each of the tumbler pins 4 is positioned entirely within the second plug member 2, placing the lock in an unlocked condition. The second plug member 2 and barrel 6 are therefore rotatable within shell 8, since no pins extend between plugs 1 and 2. Barrel 6 rotates with second plug member 2 since the flange 26 of the second plug member 2 is dimensioned to extend into the vertical channel 64 of the barrel 6, but does not extend into the vertical channel 81. The flange 15 of the first plug member 1 is dimensioned to extend into the vertical channel 81 of the outer shell 8 and thereby remains stationary with respect thereto. Thus, when rotating the second plug member 2, the barrel 6 and the latch 65 rotate simultaneously therewith. The projection 711 of the setting plate 71 is free to rotate with the inner shell 6 through the slit 82 and will be blocked from further rotation when it reaches the end of the slit 82.

FIG. 4B is a top cross-sectional view showing the arms 91 of the key 9 located beneath the through holes 23, and thus in alignment with the tumbler pins.

FIG. 5 is a perspective view of the lock structure to be installed in a lock housing 10. Upon the completion of assembly, the lock core provides the best of theft protection absent damage to the lock body itself.

While only a particular embodiment of the present invention has been described, it will be apparent to thos skilled in the art that various changes and modifications may be made herein without departing from the spirit and scope of the invention as claimed.

I claim:

1. A lock core comprising:

a. a longitudinally extending outer shell having a cylindrical outer wall defining a tubular passage extending therethrough, said tubular passage having first and second open ends, said outer wall having a first longitudinally directed slotted through opening and a transversely directed slotted through opening being formed therein, said transversely directed slotted through opening extending from said first longitudinally directed slotted through opening and being in open communication therewith;

b. a barrel member having a longitudinally extended hollow recess open on one end thereof, said barrel member having a second longitudinally directed slotted through opening formed in an outer wall, said barrel member being positioned within the said tubular passage through said first open end of said outer shell with said second slotted through opening being radially aligned with said first slotted through opening, said barrel member having a closed end opposite said open end extending through said second open end of said outer shell for engagement with a lock mechanism;

c. a spring biased setting plate disposed within said hollow recess of said barrel member, said setting plate having a tab portion extending through both said first and second slotted through openings for guiding longitudinal displacement of said setting plate, said spring bias being supplied by a first spring member disposed between said setting plate and said closed end of said barrel member;

d. a cylindrically shaped first plug member disposed within said tubular passage of said outer shell adjacent said first open end thereof, said first plug member having a first cross-shaped open keyway passage extending longitudinally therethrough, said first plug member being formed with a plurality of bore holes extending from a lower surface thereof and being disposed between adjacent open areas of said first cross-shaped keyway passage, said first plug member having a first projection extending from an outer wall surface thereof for engagement with said first slotted through opening of said outer shell;

e. a cylindrically shaped second plug member disposed within said barrel member in axial alignment with said first plug member and longitudinally positioned between said first plug member and said setting plate in abutting relation therewith, said second plug member having a second cross-shaped open keyway passage extending longitudinally therethrough, said second plug member being formed with a plurality of through holes extending longitudinally therethrough and being disposed between adjacent open areas of said second cross-shaped keyway passage, said second plug member having a second projection extending from an outer wall surface thereof for engagement with said second slotted through opening of said barrel member for rotational displacement of said barrel member responsive to a rotational displacement of said second plug member;

f. a plurality of first tumbler pins, each of said plurality of first tumbler pins being disposed within a respective one of said plurality of bore holes of said first plug member;

g. a plurality of second spring members, each of said second spring members being disposed within a respective one of said plurality of bore holes of said first plug member between a respective one of said first tumbler pins and a closed end of said bore hole, each of said second spring members biasing a respective one of said first tumbler pins into a respective one of said plurality of through holes of said second plug member for substantially preventing rotation of said second plug member relative to said first plug member; and, h. a plurality of second tumbler pins, each of said plurality of second tumbler pins being disposed within a respective one of said plurality of through holes of said second plug member, each of said second tumbler pins having one end abutting a respective one of said first tumbler pins and an opposing end extending through a reduced diameter end of said through hole, whereby a key having a plurality of radially directed arms is insertable through said first and second keyway passages for longitudinally displacing said setting plate to permit rotation of said key arms within a cavity formed in said second plug member and thereby displace said first and second tumbler pins against a bias force of said second spring members, said displacement being sufficient to position both said plurality of first tumbler pins entirely within said first plug member and said plurality of second tumbler pins within said second plug member to permit relative rotation therebetween when a valid key is used.

2. The lock core as recited in claim 1 where said tab portion of said setting plate passes through said transversely directed slotted through opening of said outer shell during rotation of said barrel member, said rotation being limited by a length dimension of said transversely directed slotted through opening.

* * * * *